US005888094A

United States Patent [19]

Kubota et al.

[11] Patent Number: 5,888,094

[45] Date of Patent: Mar. 30, 1999

[54] COAXIAL CONNECTOR

[75] Inventors: Hiroshi Kubota; Toshio Takahashi, both of Nisshin, Japan

[73] Assignee: Advanced Mobile Telecommunication Technolgy Inc., Aichi-ken, Japan

[21] Appl. No.: 821,294

[22] Filed: Mar. 20, 1997

[30] Foreign Application Priority Data

Sep. 5, 1996 [JP] Japan ..... 8-234788

[51] Int. Cl.[6] ..... H01R 9/05

[52] U.S. Cl. ..... 439/583

[58] Field of Search ..... 439/583, 578–585, 439/271, 283

[56] References Cited

U.S. PATENT DOCUMENTS 3,530,425 9/1970 Vachhani ..... 439/583
3,739,076 6/1973 Schwartz ..... 439/583
4,126,372 11/1978 Hashimoto et al. ..... 439/583
5,284,449 2/1994 Vaccaro ..... 439/583

*Primary Examiner*—Steven L. Stephan
*Assistant Examiner*—Eugene G. Byrd
*Attorney, Agent, or Firm*—Lane, Aitken & McCann

[57] ABSTRACT

Herein disclosed is a coaxial connector for connecting a coaxial cable to some device including another coaxial cable. The coaxial connector comprises a hollow ring-shaped member threaded with the coaxial cable and having an inner diameter which is slightly larger than an outer diameter of the coaxial cable. The hollow ring-shaped member has an annular cross section. The coaxial connector further comprises a cylindrical housing having a seat surface portion which allows the hollow ring-shaped member to be seated thereon, and pressing means for pressing the hollow ring-shaped member seated on the seat surface portion of the cylindrical housing to the cylindrical housing. The hollow ring-shaped member is transformed by the pressing means, thereby fixing the coaxial cable to the cylindrical housing.

23 Claims, 14 Drawing Sheets

COAXIAL CONNECTOR

BACKGROUND OF THE INVENTION

1. Field of the Invention

The present invention relates to a coaxial connector and, more particularly, to a connector used to electrically and mechanically connect a coaxial cable to some device including another coaxial cable. The coaxial cable used with the coaxial connector preferably comprises a cylindrical metal thin film serving as an outer conductor and is generally intended to transmit a radio frequency signal therethrough.

2. Description of the Related Art

There have so far been proposed a wide variety of coaxial connectors which are designed to connect coaxial cables to each other or a coaxial cable to some device. A BNC type connector is a typical of coaxial connector and used with a coaxial cable which comprises a cylindrical outer conductor formed by braiding fine metal wires, an inner conductor known as a core conductor and constituted by a metal wire, a dielectric tube member interposed between the outer conductor and the inner conductor and an insulating tube covering the outer conductor. The BNC type connector comprises a center pin, a coupling nut, a housing and a ring-shaped gasket having a thorough bore. The BNC type connector is attached to one end of the coaxial cable in the following manner. Firstly, the insulating tube is removed at one end of the coaxial cable from the coaxial cable to reveal one end portion of the outer conductor. The revealed one end portion of the outer conductor is threaded through the through bore of the ring-shaped gasket and then partially untied. The untied one end portion of the outer conductor is entangled with the ring-shaped gasket and beautifully arranged by cutting away useless wires from the outer conductor. The one end of the inner conductor protruded from the dielectric tube member is tipped with a center pin through soldering process. After the gasket and the center pin are thus attached to the coaxial cable, the coaxial cable is threaded through the coupling nut and inserted to the housing from behind. Lastly, the coupling nut is screwed to the housing, thereby finishing the process for fixing the coaxial cable to the BNC type connector.

A drawback is, however, encountered in a prior-art BNC type connector of the above described nature in that the BNC type connector cannot be used with a coaxial cable including a thin film tube as an outer conductor because of the fact that the thin film coaxial cable does not include metal wires intended to be entangled with the ring-shaped gasket of the BNC type connector.

SUMMARY OF THE INVENTION

It is an object of the present invention to provide a coaxial connector capable of connecting a coaxial cable including a thin film tube as an outer conductor to some device such as another coaxial cable.

In accordance with one aspect of the present invention, there is provided a coaxial connector for connecting a coaxial cable to some device including another coaxial cable. The coaxial connector comprises a hollow ring-shaped member threaded with the coaxial cable and having an inner diameter which is slightly larger than an outer diameter of the coaxial cable. The hollow ring-shaped member has an annular cross section. The coaxial connector further comprises a cylindrical housing having a seat surface portion which allows the hollow ring-shaped member to be seated thereon, and pressing means for pressing the hollow ring-shaped member seated on the seat surface portion of the cylindrical housing to the cylindrical housing. The hollow ring-shaped member is transformed by the pressing means, thereby fixing the coaxial cable to the cylindrical housing.

The coaxial connector may be constructed as described below. The hollow ring-shaped member seated on the seat surface portion of the cylindrical housing has a center axis registered with that of the cylindrical housing and has an internal circular axis which includes a center point of the annular cross section of the hollow ring-shaped member and which is included in a cylindrical plane parallel with the center axis of the hollow ring-shaped member. The hollow ring-shaped member has an outer surface intersecting the cylindrical plane at two circular lines. The hollow ring-shaped member has a circular side portion which circularly extends along and in the vicinity of one of the two circular lines remote from the seat surface portion of the cylindrical housing and which is pressed by the pressing means.

Alternatively, the coaxial connector may be constructed as described below. The hollow ring-shaped member has a narrow circular inside portion which is firstly brought into contact with the coaxial cable when the hollow ring-shaped member is transformed by the pressing means. The narrow circular inside portion of the hollow ring-shaped member is moved along a plane intersecting a center axis of the hollow ring-shaped member at a right angle while the hollow ring-shaped member is transformed by the pressing means. The hollow ring-shaped member has a circular portion which is brought into contact with the seat surface portion of the cylindrical housing when the hollow ring-shaped member is seated on the seat surface portion of the cylindrical housing. The circular portion of the hollow ring-shaped member has a largest outer diameter of the hollow ring-shaped member and having a crescent cross section substantially corresponding to a quarter of the annular cross section of the hollow ring-shaped member. The pressing means comprises a cylindrical pressing member has a circular flat surface which inclines with respect to the center axis of the hollow ring-shaped member. The circular flat surface of the cylindrical pressing member and the center axis of the hollow ring-shaped member define an angle smaller than a right angle. The circular flat surface of the cylindrical pressing member is brought in contact with the hollow ring-shaped member when the hollow ring-shaped member is pressed to the cylindrical housing by the pressing means. The angle may be defined in a range from 50° to 80°. Alternatively, the cylindrical housing has a recess partially defined by the seat surface portion of the cylindrical housing. The recess of the cylindrical housing is formed with an internal thread and allows the hollow ring-shaped member to be accommodated therein. The pressing means comprises a cylindrical screw member having a circular flat surface which inclines with respect to the center axis of the hollow ring-shaped member. The circular flat surface of the cylindrical screw member and the center axis of the hollow ring-shaped member define an angle smaller than a right angle. The cylindrical screw member is formed with an external thread engageable with the internal thread of the recess of the cylindrical housing. The cylindrical screw member is screwed into the recess of the cylindrical housing to bring the circular flat surface of the cylindrical screw member into contact with the hollow ring-shaped member, thereby pressing the hollow ring-shaped member to the cylindrical housing.

In accordance with another aspect of the present invention, there is provided a coaxial connector for connecting a coaxial cable to some device including another coaxial cable. The coaxial connector comprises a ring-shaped member threaded with the coaxial cable and having an inner diameter which is slightly larger than an outer diameter of the coaxial cable. The ring-shaped member has a U-shaped cross section. The coaxial connector further comprises a cylindrical housing having a seat surface portion which allows the ring-shaped member to be seated thereon, and pressing means for pressing the ring-shaped member seated on the seat surface portion of the cylindrical housing to the cylindrical housing. The ring-shaped member is transformed by the pressing means, thereby fixing the coaxial cable to the cylindrical housing.

The coaxial connector may be constructed as described below. The ring-shaped member has a center axis registered with that of the seat surface portion of the cylindrical housing and has an internal circular axis which includes a center point of the U-shaped cross section of the ring-shaped member and which is included in a cylindrical plane parallel with the center axis of the ring-shaped member. The ring-shaped member has an outer surface intersecting the cylindrical plane at a circular line. The ring-shaped member has a circular side portion which circularly extends along and in the vicinity of the circular line and which is pressed by the pressing means. The ring-shaped member has a narrow circular inside portion which is firstly brought into contact with the coaxial cable when the ring-shaped member is transformed by the pressing means. The narrow circular inside portion of the ring-shaped member is moved along a plane which intersects a center axis of the ring-shaped member at a right angle while the ring-shaped member is transformed by the pressing means. The ring-shaped member has a circular portion which is brought into contact with the seat surface portion of the cylindrical housing when the ring-shaped member is seated on the seat surface portion of the cylindrical housing. The circular portion of the ring-shaped member has a largest outer diameter of the ring-shaped member. The cylindrical housing has a recess partially defined by the seat surface portion of the cylindrical housing. The recess of the cylindrical housing includes a bottom portion formed with a circular protrusion. The circular portion of the ring-shaped member has a circular opening which is engageable with the circular protrusion of the cylindrical housing. The circular opening of the ring-shaped member is engaged with the circular protrusion of the cylindrical housing when the ring-shaped member is seated on the seat surface portion of the cylindrical housing. Alternatively, the pressing means comprises a cylindrical pressing member having a circular flat surface which inclines with respect to the center axis of the ring-shaped member. The circular flat surface of the cylindrical pressing member and the center axis of the ring-shaped member define an angle smaller than a right angle. The circular flat surface of the cylindrical pressing member is brought in contact with the ring-shaped member when the ring-shaped member is pressed to the cylindrical housing by the pressing means. The angle may be defined in a range from 50° to 80°. Alternatively, the cylindrical housing has a recess partially defined by the seat surface portion of the cylindrical housing. The recess of the cylindrical housing is formed with an internal thread and allows the ring-shaped member to be accommodated therein. The pressing means comprises a cylindrical screw member having a circular flat surface which inclines with respect to the center axis of the ring-shaped member. The circular flat surface of the cylindrical screw member and the center axis of the ring-shaped member define an angle smaller than a right angle. The cylindrical screw member is formed with an external thread engageable with the internal thread of the recess of the cylindrical housing. The cylindrical screw member is screwed into the recess of the cylindrical housing to bring the circular flat surface of the cylindrical screw member into contact with the ring-shaped member, thereby pressing the ring-shaped member to the cylindrical housing.

In accordance with a further aspect of the present invention, there is provided a coaxial connector for connecting a coaxial cable to some device including another coaxial cable. The coaxial connector comprises a cylindrical housing having the coaxial cable partially received therein and having one end portion transformable inwardly in a radial direction of the cylindrical housing to such an extent that an inner diameter of the one end portion of the cylindrical housing becomes smaller than a diameter of the coaxial cable. The coaxial connector further comprises a cylindrical retainer member formed with an axial through bore through which the coaxial cable is threaded. The axial through bore is engageable with the one end portion of the cylindrical housing. The one end portion of the cylindrical housing is transformed inwardly in the radial direction of the cylindrical housing to fix the coaxial cable to the cylindrical housing when the cylindrical retainer member is engaged with the one end portion of the cylindrical housing.

The coaxial connector may be constructed as described below. The one end portion of the cylindrical housing is formed with a plurality of slits circumferentially equiangularly spaced relationship to each other. Each of the slits opens at an edge of the one end portion of the cylindrical housing and extends along a center axis of the cylindrical housing. The axial through bore of the cylindrical retainer member is tapered from one end of the cylindrical retainer member toward the other end of the cylindrical retainer member. The cylindrical retainer member has an inner diameter smaller than a largest outer diameter of the one end portion of the cylindrical housing. The one end of the cylindrical retainer member approaches the one end portion of the cylindrical housing and is followed by the other end of the cylindrical retainer member when the cylindrical retainer member is engaged with the one end portion of the cylindrical housing.

In accordance with a yet further aspect of the present invention, there is provided a coaxial connector for connecting a coaxial cable to some device including another coaxial cable. The coaxial connector comprises a cylindrical housing having one end and the other end portions axially opposite to each other. The one end portion of the cylindrical housing is provided with an axial bore which has the coaxial cable received therein and which is tapered from an edge of the one end portion toward the other end portion of the cylindrical housing. The coaxial connector further comprises a cylindrical retainer member provided with an axial through bore having the coaxial cable received therein. The cylindrical retainer member has, at its one end, a wedge portion which is transformable inwardly in a radial direction of the cylindrical retainer member to such an extent that an inner diameter of the wedge portion of the cylindrical retainer member becomes smaller than a diameter of the coaxial cable. The wedge portion of the cylindrical retainer member is transformed inwardly in the radial direction of the cylindrical retainer member to fix the coaxial cable to the cylindrical housing by way of the cylindrical retainer member when the cylindrical retainer member is inserted between the one end portion of the cylindrical housing and the coaxial cable.

The coaxial connector may be constructed as described below. The wedge portion of the cylindrical retainer member is formed with a plurality of slits circumferentially equiangularly spaced relationship to each other. Each of the slits opens at an edge of the wedge portion of the cylindrical retainer member and extends alone a center axis of the cylindrical retainer member. The axial bore of the one end portion of the cylindrical housing has an inner diameter smaller than a largest outer diameter of the wedge portion of the cylindrical retainer member. The one end of the cylindrical retainer member approaches the one end portion of the cylindrical housing and is followed by the other end of the cylindrical retainer member when the cylindrical retainer member is engaged with the one end portion of the cylindrical housing.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DESCRIPTION OF THE PREFERRED EMBODIMENTS

Referring to FIGS. 1 to 9 of the drawings, a first preferred embodiment of the coaxial connector according to the present invention will be described hereinafter. The coaxial connector serves as a device for connecting a coaxial cable 1 shown in FIG. 1 to some device (not shown) including another coaxial cable. The coaxial cable 1 comprises an inner conductor 1*a* of metal wire, an outer conductor 1*b* of metal thin film tube encircling the inner conductor 1*a*, and a dielectric tube member 1*c* intervening between the inner conductor 1*a* and the outer conductor 1*b*. The metal thin film tube forming the outer conductor 1*b* may be, for example, a superconductive thin film tube.

Figure 1:
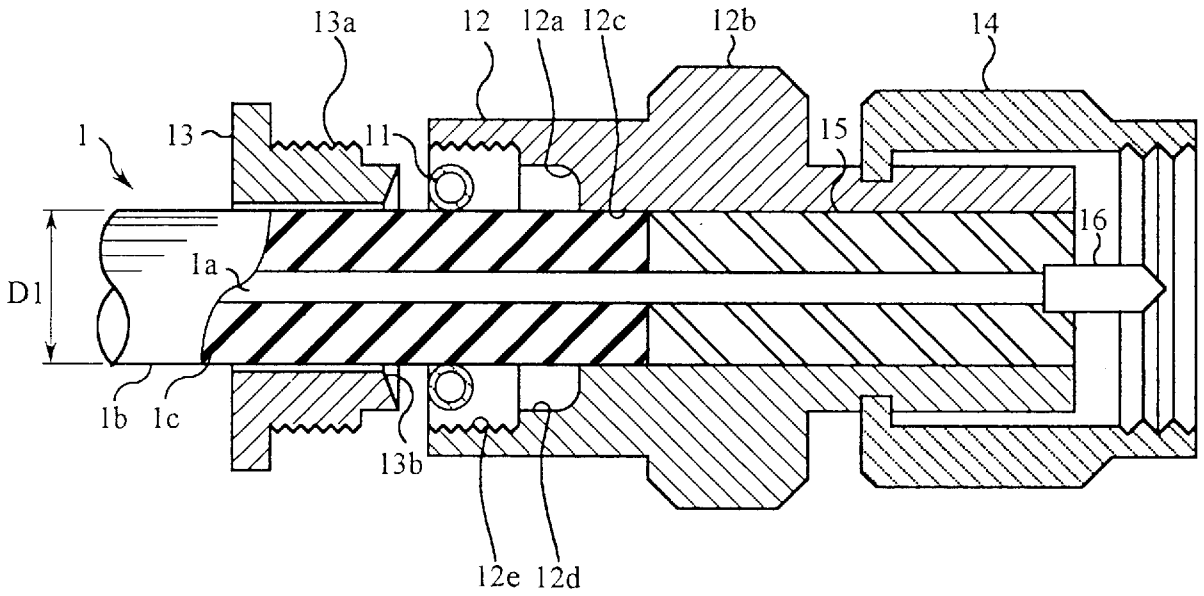
FIG. 1 is a cross sectional view showing a first preferred embodiment of a coaxial connector according to the present invention.

The coaxial connector is shown in FIG. 1 of drawings as comprising a hollow ring-shaped member 11, a cylindrical housing 12, a cylindrical screw member 13, a cylindrical cap member 14, a tube piece 15 and a center pin 16. As will be best shown in FIG. 4, the hollow ring-shaped member 11 has a thickness t, an outer diameter d and an inner diameter D2 slightly larger than an outer diameter D1 of the coaxial cable 1. The hollow ring-shaped member 11 is threaded with the coaxial cable 1 and has an annular cross section. The cylindrical housing 12 has a seat surface portion 12*a* which allows the hollow ring-shaped member 11 to be seated thereon. The cylindrical screw member 13 serves as pressing means for pressing the hollow ring-shaped member 11 seated on the seat surface portion 12*a* of the cylindrical housing 12 to the cylindrical housing 12 to transform the hollow ring-shaped member 11, thereby fixing the coaxial cable 1 to the cylindrical housing 12.

Figure 2:
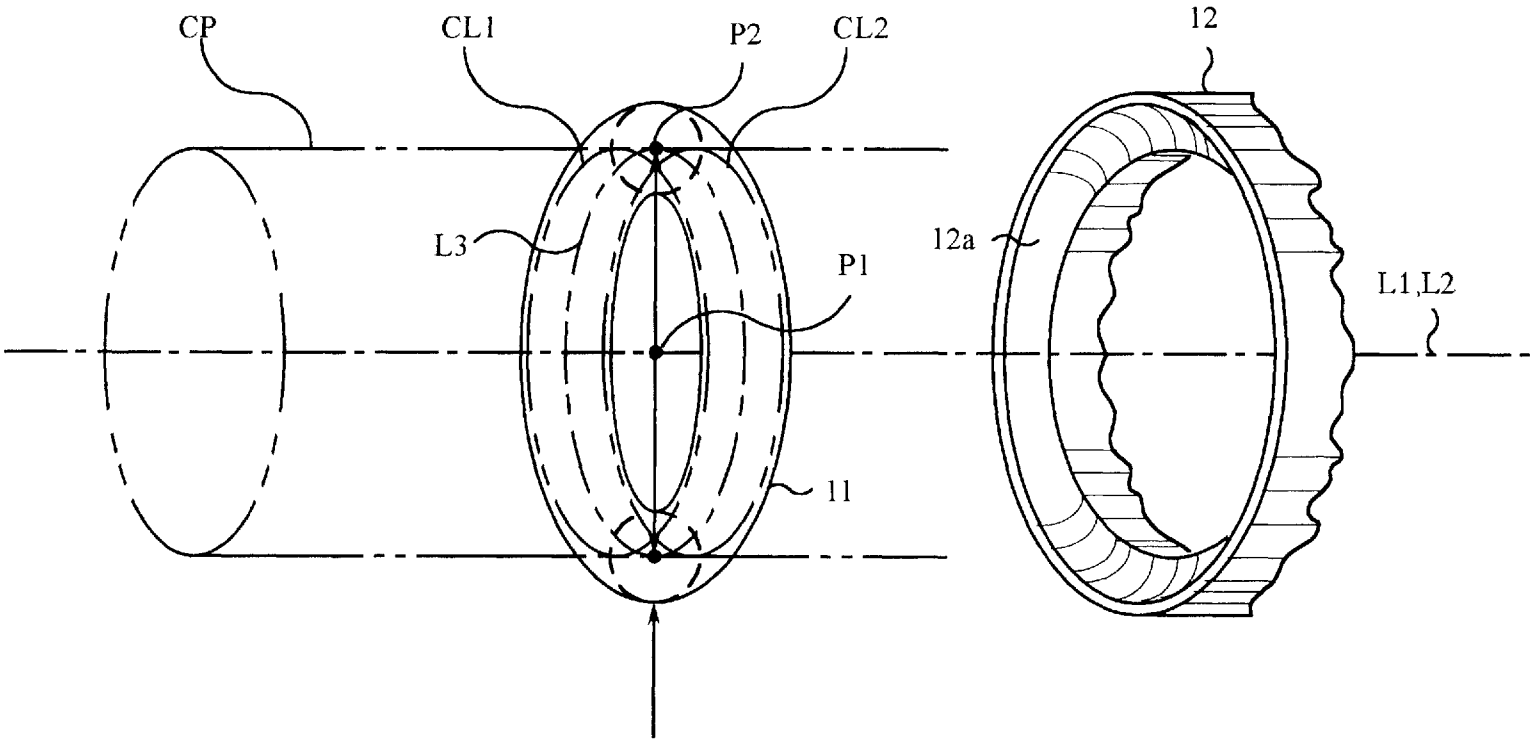
FIG. 2 is a perspective exploded view showing a hollow ring-shaped member and part of a cylindrical housing shown in FIG. 1.
Figure 3:
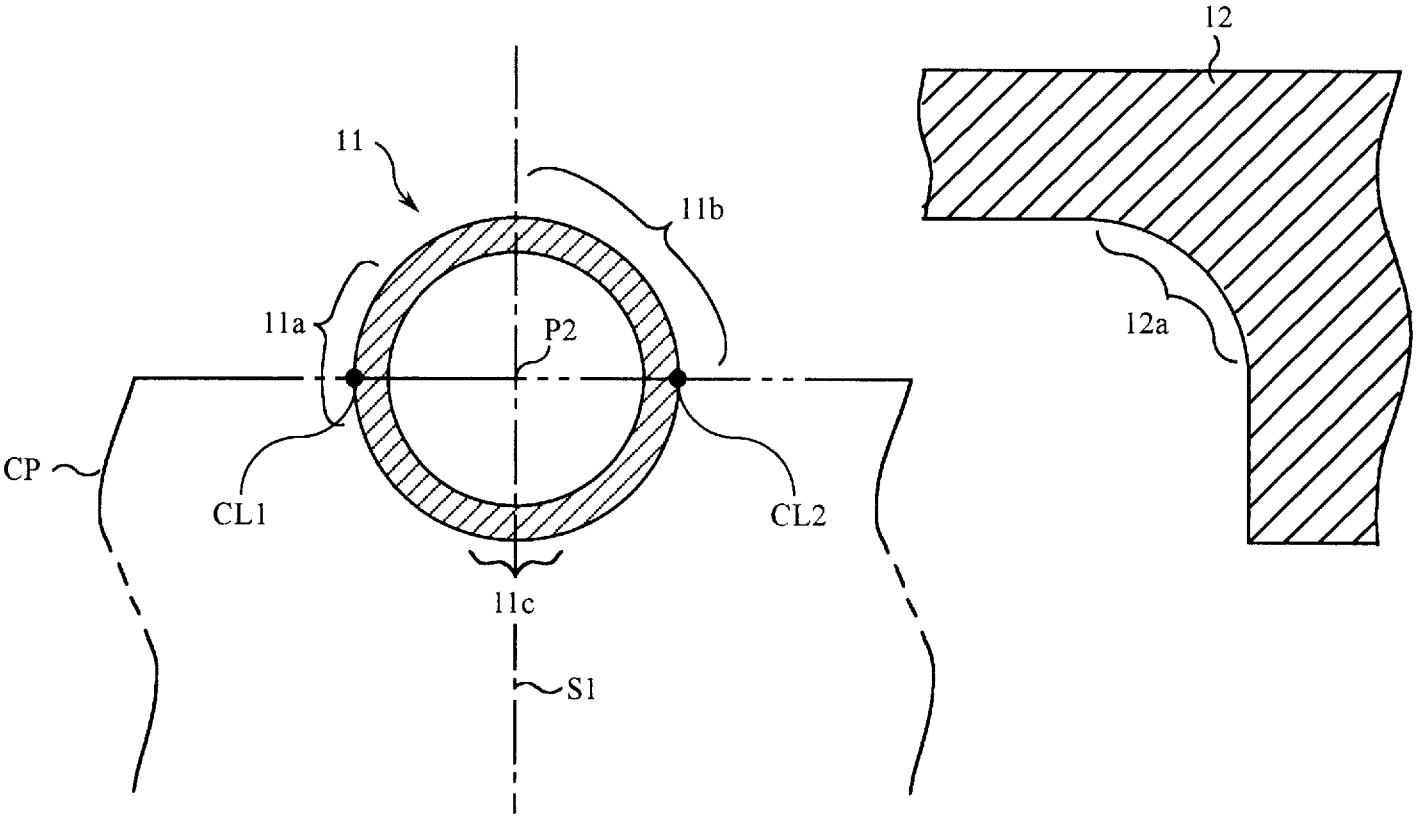
FIG. 3 is a cross sectional view showing the hollow ring-shaped member and part of the cylindrical housing shown in FIG. 1.
Figure 4:
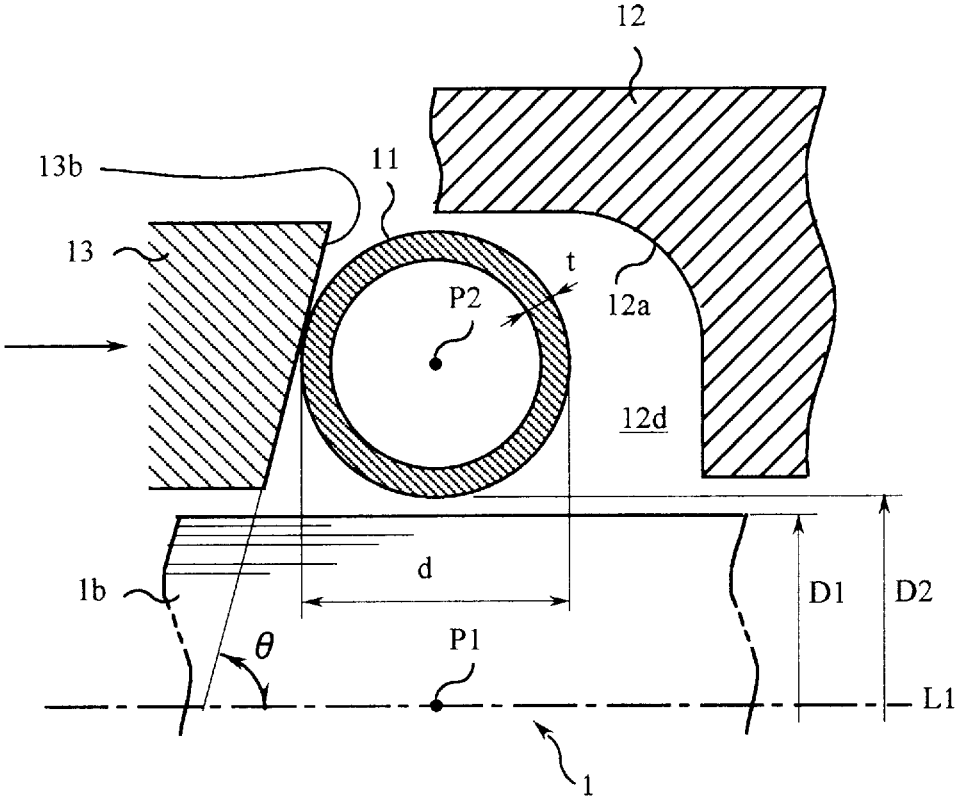
FIG. 4 is a cross sectional view of part of the coaxial connector shown in FIG. 1.
Figure 5:
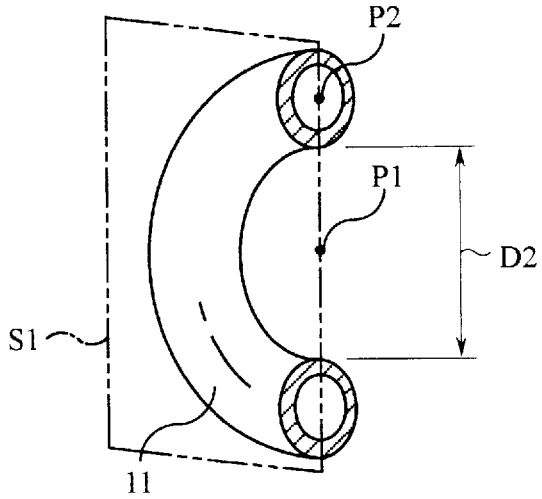
FIG. 5 is a perspective fragmentary view showing the hollow ring-shaped member shown in FIG. 1.

FIG. 2 of the drawings is a perspective exploded view showing the hollow ring-shaped member 11 and part of the cylindrical housing 12, while FIG. 3 of the drawings is an exploded cross sectional view showing them. As shown in FIG. 2, the hollow ring-shaped member 11 has a center axis L1 including a center point P1 of the hollow ring-shaped member 11. On the other hand, the cylindrical housing 12 has a center axis L2. The center axes L1 and L2 of the hollow ring-shaped member 11 and the cylindrical housing 12 are registered with each other when the hollow ring-shaped member 11 is seated on the seat surface portion 12*a* of the cylindrical housing 12. In addition, the hollow ring, -shaped member 11 has an internal circular axis L3 that includes a center point P2 of the annular cross section of the hollow ring-shaped member 11 and that is included in a cylindrical plane CP parallel with the center axis L1 of the hollow ring-shaped member 11.

As shown in FIG. 2, the hollow ring-shaped member 11 has an outer surface intersecting the cylindrical plane CP at two circular lines CL1 and CL2. When the hollow ring-shaped member 11 is threaded with the coaxial cable 1 in order to fix the coaxial cable 1 to the cylindrical housing 12, the seat surface portion 12*a* of the cylindrical housing 12 is remote from the circular line CL1 and near to the circular line CL2. As will be understood from FIGS. 2 and 3, the hollow ring-shaped member 11 has a circular side portion 11 a that circularly extends along and in the vicinity of one of the two circular lines CL1 and CL2 remote from the seat surface portion 12*a* of the cylindrical housing 12, in this case the circular line CL1, and that is pressed by the cylindrical screw member 13.

Returning back to FIG. 1 of the drawings, the cylindrical housing 12 has a hexagon head portion 12*b* engageable with a tool such as a wrench (not shown). Additionally, the cylindrical housing 12 is formed with a through bore 12*c* having the coaxial cable 1 received therein. The seat surface portion 12*a* of the cylindrical housing 12 defines the through bore 12*c* in part. The cylindrical housing 12 has a recess 12*d* partially defined by the seat surface portion 12*a*. The recess 12*d* of the cylindrical housing 12 partially forms the through bore 12*c* and is partially formed with an internal thread 12*e*. The hollow ring-shaped member 11 is accommodated in the recess 12*d* of the cylindrical housing 12.

The cylindrical screw member 13 is formed with an external thread 13*a* engageable with the internal thread 12*e* of the cylindrical housing 12. In addition, the cylindrical screw member 13 has a circular flat surface 13*b* that is brought into contact with the circular side portion 11*a* of the hollow ring-shaped member 11 when the cylindrical screw member 13 is screwed into the cylindrical housing 12.

The cylindrical cap member 14 has one end portion rotatably supported by the cylindrical housing 12 and the other end portion formed with an internal thread engageable with an external thread formed on a connection device (not shown). The tube piece 15 is made of dielectric material and received in the through bore 12*c* of the cylindrical housing 12. The inner conductor 1*a* has an end portion which protrudes from the dielectric tube member 1*c* and which is inserted into the tube piece 15 and tipped with the center pin 16.

Figure 6:
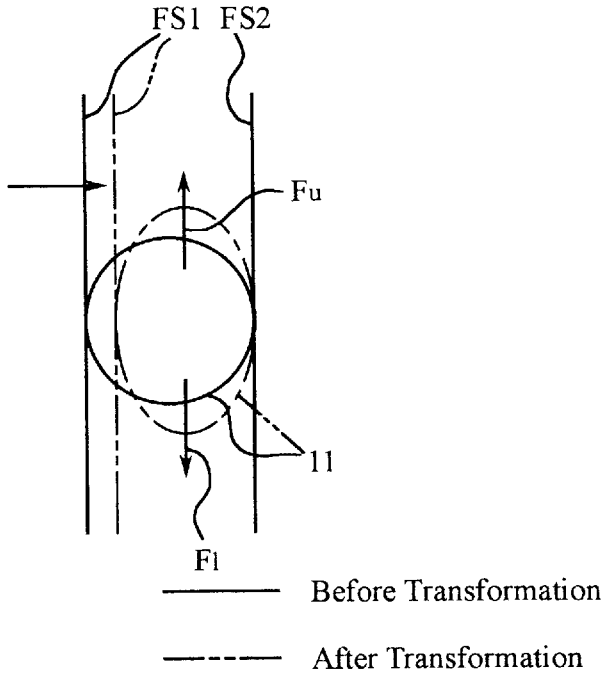
FIG. 6 is a schematic view for explaining a problem caused when the hollow ring-shaped member is pressed by a flat surface to another flat surface.

As will be understood from the foregoing description and FIG. 3, the seat surface portion 12*a* of the cylindrical housing 12 is brought into contact with a circular portion 11*b* of the hollow ring-shaped member 11 in a uniform way when the hollow ring-shaped member 11 is seated on the cylindrical housing 12. The circular portion 11*b* has a crescent cross section substantially corresponding to a quarter of the annular cross section of the hollow ring-shaped member 11. Specifically, the seat surface portion 12*a* of the cylindrical housing 12 is brought into contact with the circular portion 11*b* having a largest outer diameter of the hollow ring-shaped member 11 when the hollow ring-shaped member 11 is seated on the cylindrical housing 12. In addition, the seat surface portion 12*a* of the cylindrical housing 12 has a curved surface having the same curvature as that of the outer curved surface of the circular portion 11*b* of the hollow ring-shaped member 11. The reason why the seat surface portion 12*a* of the cylindrical housing 12 is thus formed is described below. It is now assumed that the hollow ring-shaped member 11 is pressed by a flat surface FS1 to another flat surface FS2 opposite to the flat surface FS1 as shown in FIG. 6. The cross section of the hollow ring-shaped member 11 shown in FIG. 6 represents the upper part of the cross section of the hollow ring-shaped member 11 shown in FIG. 5. When the flat surface FS1 approaches the flat surface FS2, the hollow ring-shaped member 11 is transformed so as to swell in directions Fu and Fl. Since the hollow ring-shaped member 11 is threaded with the coaxial cable 1, the hollow ring-shaped member 11 has the degree of freedom to swell in the direction Fu which is larger than that in the direction Fl. As a result, the hollow ring-shaped member 11 is transformed to more swell in the direction Fu in comparison with the direction Fl. The transformation of the hollow ring-shaped member 11 cannot ensure that the coaxial cable 1 is fixed to the cylindrical housing 12. In the present embodiment, the seat surface portion 12*a* of the cylindrical housing 12 is formed as described hereinbefore and shown in FIG. 3. Therefore, the hollow ring-shaped member 11 has no freedom to swell in the direction Fu and is liable to swell in the direction Fl, thereby ensuring that the coaxial cable 1 is fixed to the cylindrical housing 12. At this time, the cylindrical screw member 13 is screwed into the cylindrical housing 12 in order not to crash the extent that the hollow ring-shaped member 11. This means that the outer surface of the hollow ring-shaped member 11 continues to be a smoothly curved surface, thereby making it possible to prevent the outer conductor 1*b* of the coaxial cable 1 from being damaged and the transfer characteristic of the coaxial cable 1 from being spoiled.

Returning back to FIGS. 3 and 5 of the drawings, the hollow ring-shaped member 11 has a narrow circular inside portion 11*c* which is firstly brought into contact with the coaxial cable 1 when the hollow ring-shaped member 11 is transformed by the cylindrical screw member 13. Preferably, the narrow circular inside portion 11*c* of the hollow ring-shaped member 11 may be moved along a plane S1 intersecting the center axis L1 of the hollow ring-shaped member 11 at a right angle while the hollow ring-shaped member 11 is transformed by screwing the cylindrical screw member 13 into the cylindrical housing 12. In order to move the narrow circular inside portion 11*c* of the hollow ring-shaped member 11 along the plane S1, the circular flat surface 13*b* of the cylindrical screw member 13 is required to incline with respect to the center axis L1 of the hollow ring-shaped member 11. More specifically, the circular flat surface 13*b* of the cylindrical screw member 13 and the center axis L1 of the hollow ring-shaped member 11 define an angle θ smaller than a right angle. The angle θ may be defined on the basis of the inner diameter D2 of the hollow ring-shaped member 11, the thickness t of the hollow ring-shaped member 11, and the outer diameter d of the hollow ring-shaped member 11. Assuming that the inner diameter D2 of the hollow ring-shaped member 11 is 1.5 times larger than the outer diameter d of the hollow ring-shaped member 11, the angle θ may be preferably defined within appropriate one of ranges described as follows:

| t/d | θ |
|---|---|
| 0.050 | 70° to 80° |
| 0.075 | 55° to 80° |
| 0.100 | 50° to 80° |

Figure 7:
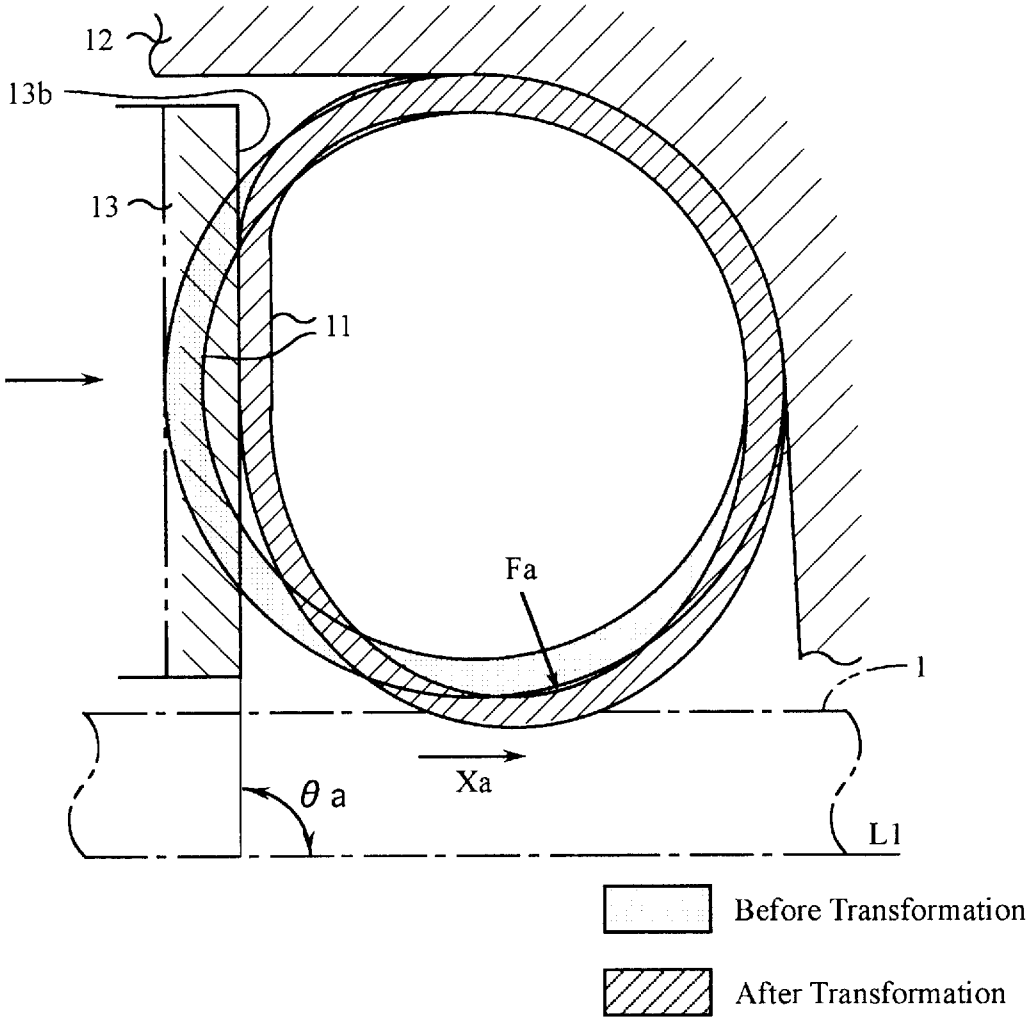
FIG. 7 is an enlarged cross sectional view showing a state of the transformation of the hollow ring-shaped member when an angle defined between a center axis of the coaxial cable and a cylindrical flat surface of a cylindrical screw member shown in FIG. 1 is equal to a right angle.

The experiments are carried out with three angles θa, θb and θc with the intention of proving that the angle θ smaller than a right angle is superior to other angles. FIG. 7 shows the cross section of the hollow ring-shaped member 11 transformed by the circular flat surface 13*b* which defines the angle θa equal to a right angle in cooperation with the center axis L1 of the hollow ring-shaped member 11. As will be apparent from FIG. 7, the hollow ring-shaped member 11 is transformed to swell in a direction Fa that is not perpendicular to the outer surface of the coaxial cable 1, i.e., the narrow circular inside portion 11*c* of the cylindrical housing 11 is shifted in a direction Xa while the hollow ring-shaped member 11 is transformed. This means that the outer conductor 1*b* of the coaxial cable 1 is rubbed with the hollow ring-shaped member 11 while the cylindrical screw member 13 is screwed into the cylindrical housing 12. As a consequence, the outer conductor 1*b* of the coaxial cable 1 is damaged by the hollow ring-shaped member 11.

Figure 8:
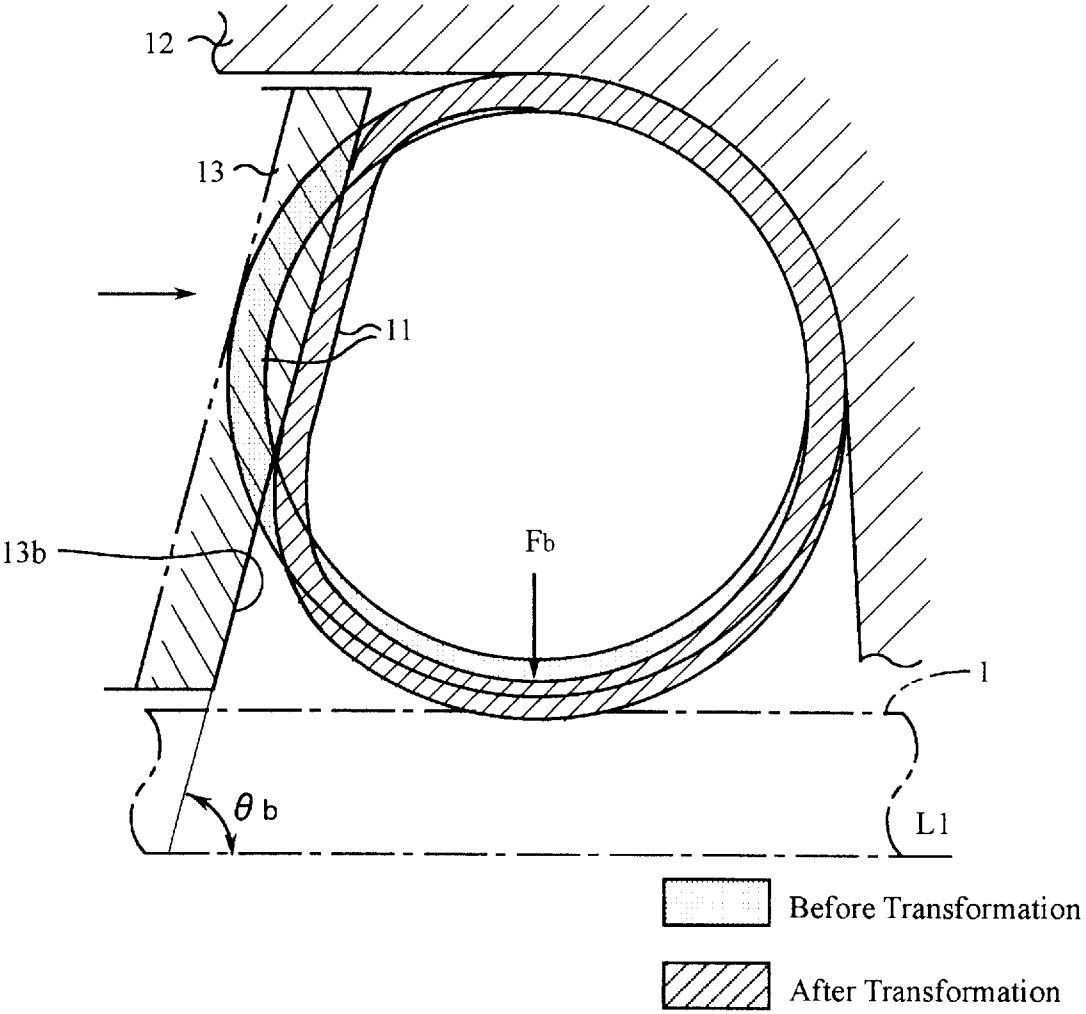
FIG. 8 is an enlarged cross sectional view showing the state of the transformation of the hollow ring-shaped member when the angle defined between the center axis of the coaxial cable and the cylindrical flat surface of the cylindrical screw member is smaller than a right angle.

FIG. 8 shows the cross section of the hollow ring-shaped member 11 transformed by the circular flat surface 13*b* which defines the angle θb smaller than a right angle in cooperation with the center axis L1 of the hollow ring-shaped member 11. Here the angle θb is 75°. As will be apparent from FIG. 8, the hollow ring-shaped member 11 is transformed to swell in a direction Fb that is substantially perpendicular to the outer surface of the coaxial cable 1. This means that the outer conductor 1*b* of the coaxial cable 1 is pressed by the hollow ring-shaped member 11 without being rubbed with the hollow ring-shaped member 11. The outer conductor 1*b* of the coaxial cable 1, therefore, is prevented from being damaged by the hollow ring-shaped member 11.

Figure 9:
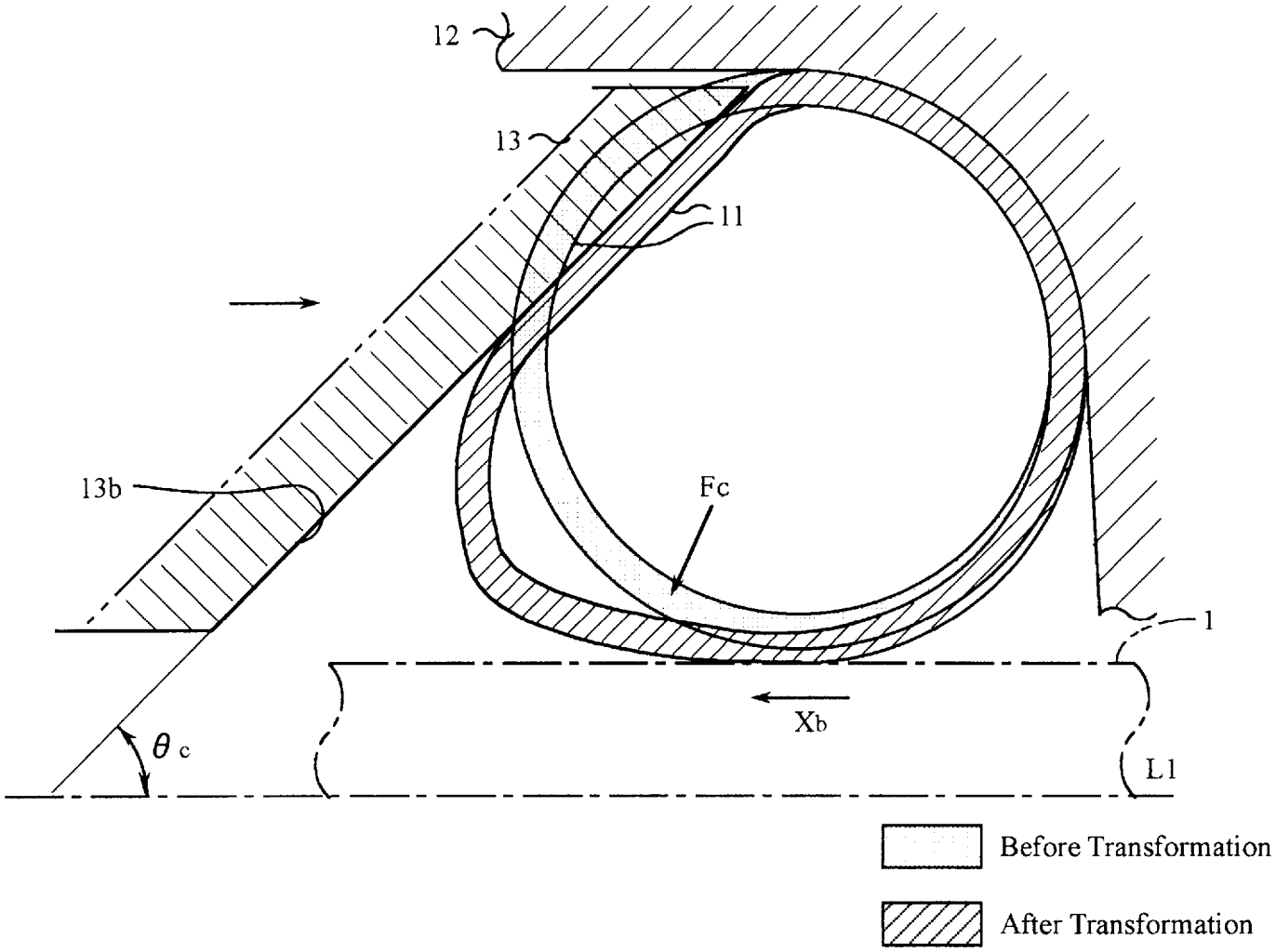
FIG. 9 is an enlarged cross sectional view showing the state of the transformation of the hollow ring-shaped member when the angle defined between the center axis of the coaxial cable and the cylindrical flat surface of the cylindrical screw member is considerably smaller than a right angle.

FIG. 9 shows the cross section of the hollow ring-shaped member 11 transformed by the circular flat surface 13*b* which defines the angle θc smaller than θb or considerably smaller than a right angle in cooperation with the center axis L1 of the hollow ring-shaped member 11. Here the angle θb is 45°. As will be apparent from FIG. 9, the hollow ring-shaped member 11 is transformed to swell in a direction Fc that is not perpendicular to the outer surface of the coaxial cable 1, i.e., the narrow circular inside portion 11*c* of the cylindrical housing 11 is shifted in a direction Xb while the hollow ring-shaped member 11 is transformed. Similarly to the result of the experiment shown in FIG. 7, the outer conductor 1*b* of the coaxial cable 1 is rubbed with the hollow ring-shaped member 11 and, accordingly, damaged.

As will be appreciated from the foregoing description, the inner diameter of the hollow ring-shaped member 11 is sufficiently decreased by screwing the cylindrical screw member 13 into the cylindrical housing, so that the coaxial cable 1 can be a sufficiently constricted by the hollow ring-shaped member 11. The coaxial cable 1, therefore, is fixed to the cylindrical housing 12 without soldering process. The foregoing coaxial connector is suited to connect the coaxial cable including a metal thin tube as an outer conductor to other devices. In addition, the outer surface of the hollow ring-shaped member 11 continues to be a smoothly curved surface while and after the screw member 13 is screwed into the cylindrical housing 12, thereby making it possible to prevent the outer conductor 1*b* of the coaxial cable 1 from being damaged and the transfer characteristic of the coaxial cable 1 from being spoiled. The coaxial connector having the foregoing advantages is extremely suitable to connect the coaxial cable including a superconductive thin film tube as an outer conductor to some device.

Figure 10:
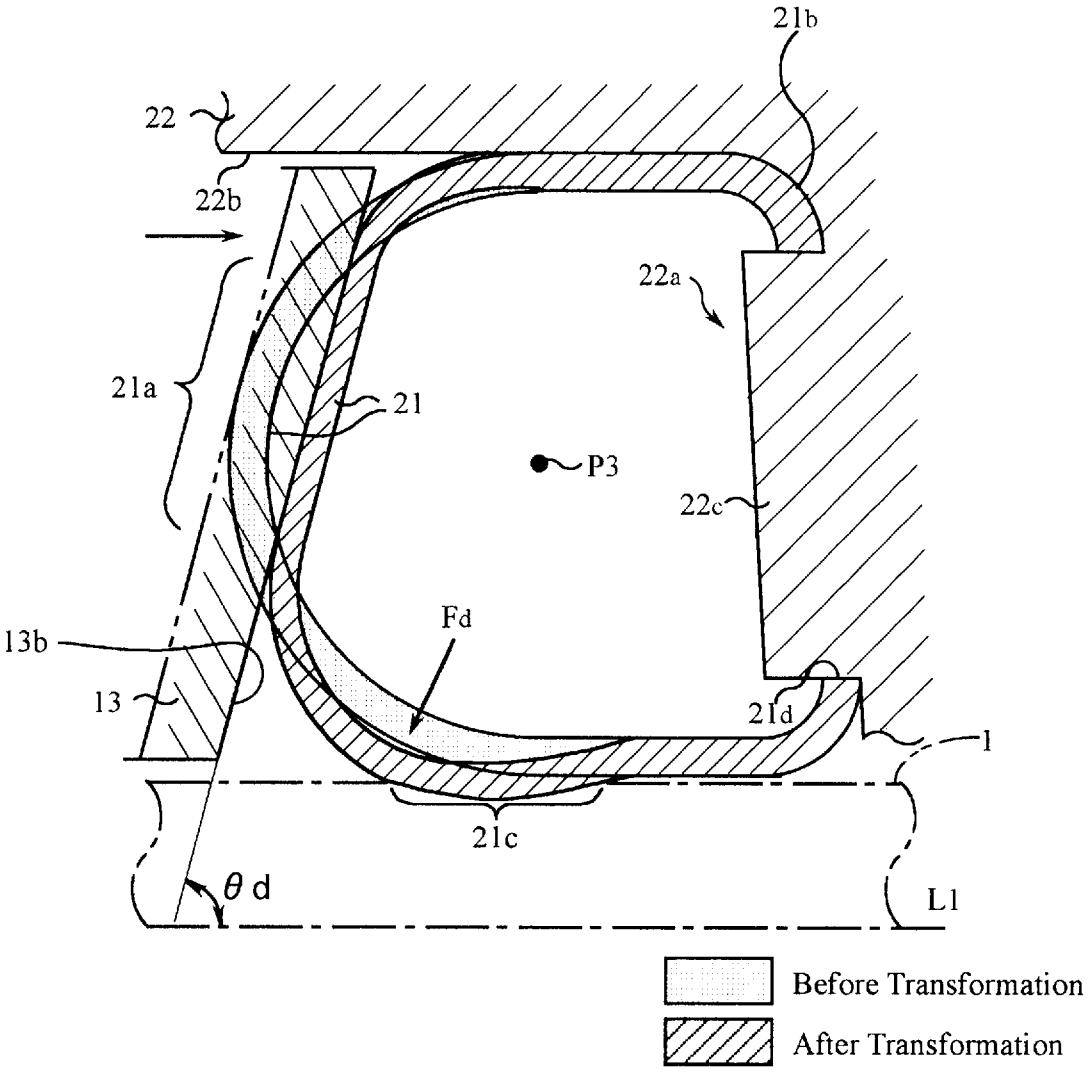
FIG. 10 is an enlarged cross sectional view of part of a second preferred embodiment of the coaxial connector according to the present invention and shows a state of the transformation of a ring-shaped member when an angle defined between a center axis of the coaxial cable and a circular flat surface of a cylindrical screw member is smaller than a right angle.
Figure 11:
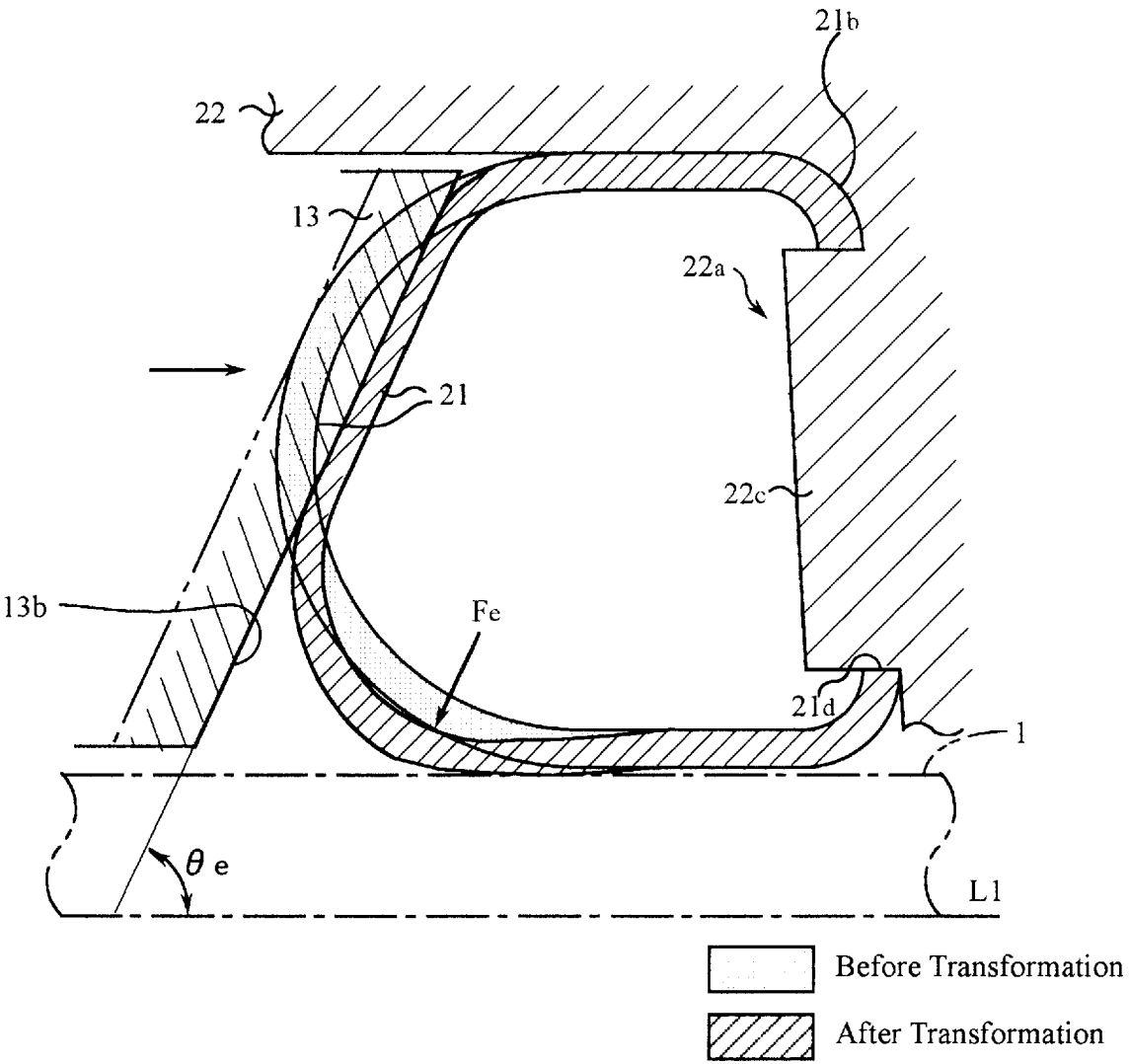
FIG. 11 is an enlarged cross sectional view showing the sate of the transformation of the ring-shaped member when the angle defined between the center axis of the coaxial cable and the circular flat surface of the cylindrical screw member is considerably smaller than a right angle.

Referring to FIGS. 10 and 11 of the drawings, a second preferred embodiment of the coaxial connector according to the present invention will be described hereinafter. The second embodiment of the coaxial connector is constructed similarly to the first embodiment, except for a ring-shaped member 21 and a cylindrical housing 22. For this reason, the constitutional elements except the ring-shaped member 21 and the cylindrical housing 22 are not explained herein with the intention of omitting repeated description thereof The ring-shaped member 21 is threaded with the coaxial cable 1 and has an inner diameter which is slightly larger than an outer diameter of the coaxial cable 1. As shown in FIG. 10, the ring-shaped member 21 has a U-shaped cross section. The cylindrical housing 22 has a seat surface portion 22*a* which allows the ring-shaped member 21 to be seated thereon. When the ring-shaped member 21 is seated on the seat surface portion 22*a* of the cylindrical housing 22, the ring-shaped member 21 is pressed by the cylindrical screw member 13 and accordingly transformed, thereby fixing the coaxial cable 1 to the cylindrical housing 22.

More specifically, the ring-shaped member 21 has a center axis L1 registered with that of the cylindrical housing 22 and has an internal circular axis which includes a center point P3 of the U-shaped cross section of the ring-shaped member 21 and which is included in a cylindrical plane parallel with the center axis L1 of the ring-shaped member 21. The internal circular axis of the ring-shaped member 21, the center axis of the cylindrical housing 22 and the cylindrical plane are not shown in FIGS. 10 and 11.

The ring-shaped member 21 has an outer surface intersecting the cylindrical plane at a circular line (not shown). The ring-shaped member 21 has a circular side portion 21*a* which circularly extends along and in the vicinity of the circular line and which is pressed by the cylindrical screw member 13.

The ring-shaped member 21 has a circular portion 21*b* brought into contact with the seat surface portion 22*a* of the cylindrical housing 22 when the ring-shaped member 21 is seated on the seat surface portion 22*a* of the cylindrical housing 22. The circular portion 21*b* of the ring-shaped member 21 has a largest outer diameter of the ring-shaped member 21.

The cylindrical housing 22 has a recess 22*b* partially defined by the seat surface portion 22*a*. The recess 22*b* of the cylindrical housing 22 includes a bottom portion formed with a circular protrusion 22*c*. The circular portion 21*b* of the ring-shaped member 21 has a circular opening 21*d* engageable with the circular protrusion 22*c* of the cylindrical housing 22. The circular opening 21*d* of the ring-shaped member 21 is engaged with the circular protrusion 22*c* of the cylindrical housing 22 when the ring-shaped member 21 is seated on the seat surface portion 22*a* of the cylindrical housing 22.

As described hereinbefore, the circular portion 21*b* of the ring-shaped member 21 has the largest outer diameter of the ring-shaped member 21. This ensures that the coaxial cable 1 is fixed to the cylindrical housing 22 similarly to the first embodiment of the coaxial connector. At this time, the cylindrical screw member 13 is screwed into the cylindrical housing 22 in order not to crash the extent that the ring-shaped member 21. This results in the fact that the outer surface of the ring-shaped member 21 continues to be a smoothly curved surface, thereby making it possible to prevent the outer conductor 1*b* of the coaxial cable 1 from being damaged and the transfer characteristic of the coaxial cable 1 from being spoiled. Furthermore, in the second embodiment the circular opening 21*d* of the ring-shaped member 21 is engaged with the circular protrusion 22*c* of the cylindrical housing 22 when the ring-shaped member 21 is seated on the seat surface portion 22*a* of the cylindrical housing 22. For this reason, the ring-shaped member 21 can be preciously set in the cylindrical housing 22 and, as a consequence, the ring-shaped member 21 can be prevented from being lost.

In the meantime, the ring-shaped member 21 has a narrow circular inside portion 21*c* which is firstly brought into contact with the coaxial cable 1 when the ring-shaped member 21 is transformed by the cylindrical screw member 13. Similarly to the first embodiment of the coaxial connector, the narrow circular inside portion 21*c* of the ring-shaped member 21 may be moved along a plane intersecting the center axis L1 of the ring-shaped member 21 at a right angle while the ring-shaped member 21 is transformed by the cylindrical screw member 13. In order to move the narrow circular inside portion 21*c* of the ring-shaped member 21 along the plane intersecting the center axis L1 of the ring-shaped member 21 at a right angle, the circular flat surface 13*b* of the cylindrical screw member 13 inclines with respect to the center axis L1 of the ring-shaped member 21. Similarly to the first embodiment of the coaxial cable, the circular flat surface 13*b* of the cylindrical screw member 13 and the center axis L1 of the ring-shaped member 21 define an angle smaller than a right angle. FIG. 10 shows a state of the transformation of the ring-shaped member 21 pressed by the circular flat surface 13*b* of the cylindrical screw member 13 which defines an angle θd smaller than a right angle in cooperation with the center axis L1 of the ring-shaped member 21, while FIG. 11 shows a state of the transformation of the ring-shaped member 21 pressed by the circular flat surface 13*b* of the cylindrical screw member 13 which defines an angle θe smaller than θd or considerably smaller than a right angle in cooperation with the center axis L1 of the ring-shaped member 21. As will be understood from FIG. 10, the ring-shaped member 21 is transformed to swell in a direction Fd, so that the narrow circular inside portion 21*c* of the ring-shaped member 21 can be moved along the plane intersecting the center axis L1 of the ring-shaped member 21 at a right angle. In addition, the transformation of the ring-shaped member 21 shown in FIG. 10 is sufficient to fix the coaxial cable 1 to the cylindrical housing 22. On the other hand, although the ring-shaped member 21 shown in FIG. 11 is transformed to swell in a direction Fe, the transformation of the ring-shaped member 21 is insufficient to fix the coaxial cable 1 to the cylindrical housing 22 as will be appreciated from FIG. 11. Therefore, the angle θd shown in FIG. 10 is superior to the angle De shown in FIG. 11.

Similarly to the first embodiment, the inner diameter of the ring-shaped member 21 is sufficiently decreased by screwing the cylindrical screw member 13 into the cylindrical housing 22, so that the coaxial cable 1 can be sufficiently constricted by the ring-shaped member 21. The coaxial cable 1, therefore, is fixed to the cylindrical housing 22 without soldering process. The foregoing coaxial connector is suited to connect the coaxial cable including a metal thin tube as an outer conductor to other devices. In addition, the outer surface of the ring-shaped member 21 continues to be a smoothly curved surface while and after the cylindrical screw member 13 is screwed into the cylindrical housing 22, thereby making it possible to prevent the outer conductor 1*b* of the coaxial cable 1 from being damaged and the transfer characteristic of the coaxial cable 1 from being spoiled. The coaxial connector having the foregoing advantages is extremely suitable to connect the coaxial cable including a superconductive thin film tube as an outer conductor to some device.

Referring to FIGS. 12 to 15 of the drawings a third preferred embodiment of the coaxial connector according to the present invention will be described hereinafter. The third embodiment of the coaxial connector includes the same constitutional elements as the first embodiment of the coaxial connector does. The constitutional elements of the third embodiment are respectively designated by the same reference numerals and symbols as the individual constitutional elements of the first embodiment are done, with the intention of omitting repeated description thereof.

Figure 12:
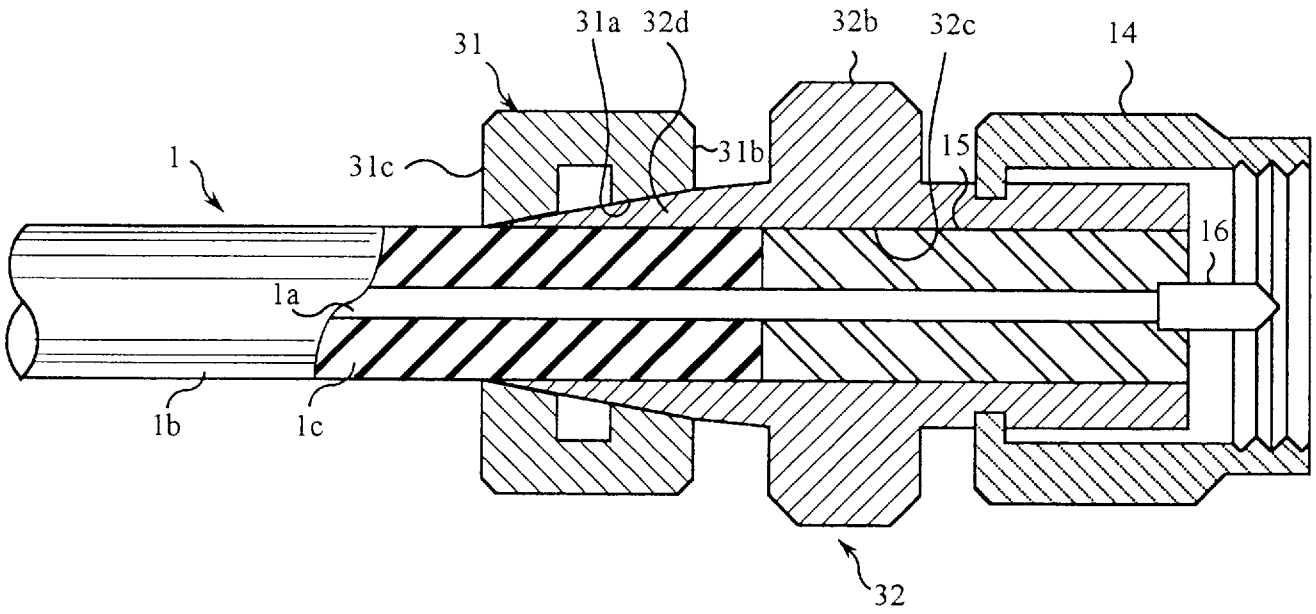
FIG. 12 is a cross sectional view showing a third preferred embodiment of the coaxial connector according to the present invention.

The coaxial connector is shown in FIG. 12 of the drawings as comprising a cylindrical housing 32 and a cylindrical retainer member 31 in addition to the cylindrical cap member 14, the tube piece 15 and the center pin 16.

The cylindrical housing 32 has a hexagon head portion 32*b* engageable with a tool such as a wrench (not shown) and is formed with a through bore 32*c* having the coaxial cable 1 received therein. In addition, the cylindrical housing 32 has one end portion 32*d* which is transformable inwardly in a radial direction of the cylindrical housing 32 to such an extent that an inner diameter of the one end portion 32*d* of the cylindrical housing 32 becomes smaller than a diameter of the coaxial cable 1.

The cylindrical retainer member 31 is formed with an axial through bore 31*a* through which the coaxial cable 1 is threaded. The axial through bore 31*a* of the cylindrical retainer member 31 is engageable with the one end portion 32*d* of the cylindrical housing 32. The one end portion 32*d* of the cylindrical housing 32 is transformed inwardly in the radial direction of the cylindrical housing 32 when the cylindrical retainer member 31 is engaged with the one end portion 32*d* of the cylindrical housing 32.

Figure 13:
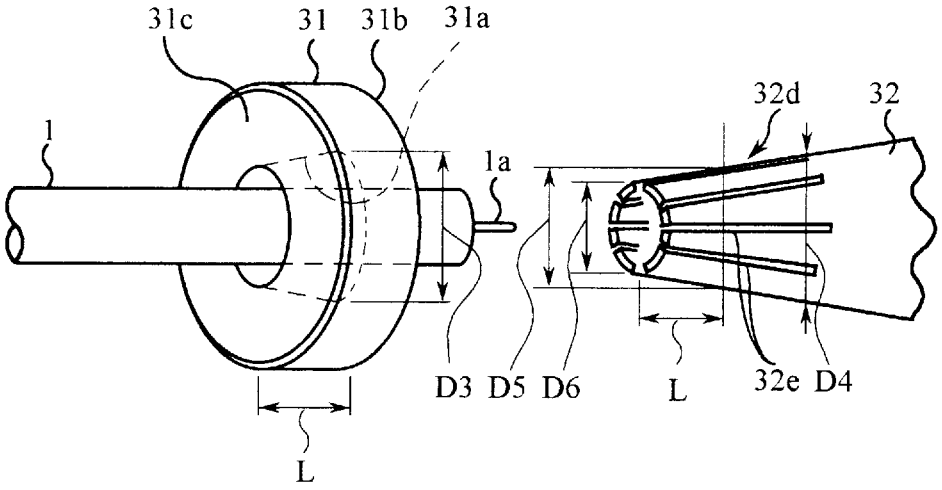
FIG. 13 is a perspective view showing a first example of a combination of a cylindrical retainer member and a cylindrical housing shown in FIG. 12.

More specifically, in FIG. 13, the one end portion 32*d* of the cylindrical housing 32 is formed with a plurality of slits 32*e* circumferentially equiangularly spaced relationship to each other. Each of the slits 32*e* of the cylindrical housing 32 opens at an edge of the one end portion 32*d* of the cylindrical housing 32 and extending along a center axis of the cylindrical housing 32. The axial through bore 31*a* of the cylindrical retainer member 31 is tapered from one end 31*b* of the cylindrical retainer member 31 toward the other end 31*c* of the cylindrical retainer member 31. The one end 31*b* of the cylindrical retainer member 31 has an inner diameter D3 smaller than the largest outer diameter D4 of the one end portion 32*d* of the cylindrical housing 32. In the present embodiment, the inner diameter D3 of the one end 31*b* of the cylindrical retainer member 31 is larger than an outer diameter D6 of the edge of the one end portion 32*d* of the cylindrical housing 32 and smaller than an outer diameter D5 of the one end portion 32*d* at a distance L from the edge of the one end portion 32*d*. The distance L is equal to an axial length of the cylindrical retainer member 31. The one end 31*b* of the cylindrical retainer member 31 approaches the one end portion 32*d* of the cylindrical housing 32 and is followed by the other end 31*c* of the cylindrical retainer member 31 when the cylindrical retainer member 31 is engaged with the one end portion 32*d* of the cylindrical housing 32. By forcibly fitting the cylindrical retainer member 31 on the one end portion 32*d* of the cylindrical housing 32, the one end portion 32*d* of the cylindrical housing 32 is transformed inwardly in the radial direction of the cylindrical housing 32 to fix the coaxial cable 1 to the cylindrical housing 32.

Figure 14:
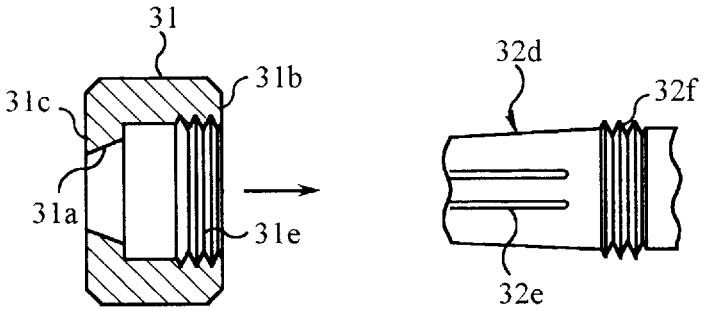
FIG. 14 is a partially sectional view showing a second example of a combination of the cylindrical retainer member and the cylindrical housing shown in FIG. 12.
Figure 15:
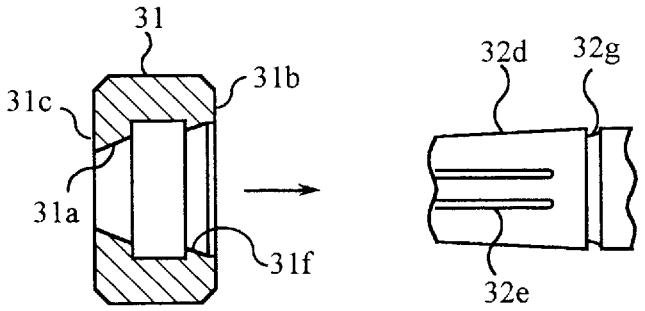
FIG. 15 is a partially sectional view showing a third example of a combination of the cylindrical retainer member and the cylindrical housing shown in FIG. 12.

The cylindrical retainer member 31 and the cylindrical housing 32 may be formed as shown in FIG. 14 or 15. In FIG. 14, the cylindrical retainer member 31 has an internal thread 31*e* at its the one end 31*b*. The cylindrical housing 32 has, at the base of the one end portion 32*d*, an external thread 32*f* engageable with the internal thread 31*e* of the cylindrical retainer member 31. By screwing the cylindrical retainer member 31 on the one end portion 32*d* of the cylindrical housing 32, the one end portion 32*d* of the cylindrical housing 32 is transformed inwardly in the radial direction of the cylindrical housing 32 to fix the coaxial cable 1 to the cylindrical housing 32. If the degree of the engagement between the internal thread 31*e* of the cylindrical retainer member 31 and the external thread 32*f* of the cylindrical housing 32 is regulated, the constriction of the coaxial cable 1 can be controlled.

In FIG. 15, the cylindrical retainer member 31 has a circular protrusion 31*f* at its the one end 31*b*. The cylindrical housing 32 has, at the base of the one end portion 32*d*, a circular groove 32*g* engageable with the circular protrusion 31*f* of the cylindrical retainer member 31. By fitting the cylindrical retainer member 31 on the one end portion 32*d* of the cylindrical housing 32 with a snap, the one end portion 32*d* of the cylindrical housing 32 is transformed inwardly in the radial direction of the cylindrical housing 32 to fix the coaxial cable 1 to the cylindrical housing 32. If the cylindrical retainer member 31 and the cylindrical housing 32 are formed shown in FIG. 15, the cylindrical retainer member 31 can be prevented from being disengaged from the one end portion 32*d* of the cylindrical housing 32, thereby ensuring that the coaxial cable 1 is fixed to the cylindrical housing 32. In addition, since the cylindrical retainer member 31 is attached to the cylindrical housing 32 with a snap, operations in the attachment of the cylindrical retainer member 31 to the cylindrical housing 32 can be simplified and reduced.

As will be appreciated form the foregoing description, the third embodiment of the coaxial connector has the same advantages as the first embodiment of the coaxial connector does.

Figure 16:
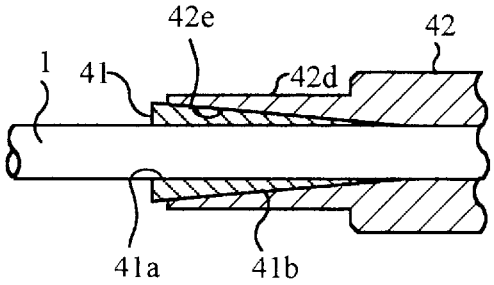
FIG. 16 is a cross sectional view partially showing a fourth preferred embodiment of the coaxial connector according to the present invention.
Figure 17:
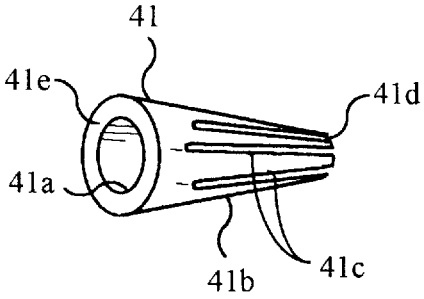
FIG. 17 is a perspective view of a cylindrical retainer member shown in FIG. 16.

Referring to FIGS. 16 and 17 of the drawings, a fourth preferred embodiment of the coaxial connector according to the present invention will be described hereinafter. The fourth embodiment of the coaxial connector is constructed similarly to the third embodiment, except for a cylindrical retainer member 41 and a cylindrical housing 42. For this reason, the constitutional elements except the cylindrical retainer member 41 and the cylindrical housing 42 are not explained herein with the intention of omitting repeated description thereof.

In FIG. 16, the cylindrical housing 42 has one end portion 42*d* and the other end portion (not shown) axially opposite to each other. The one end portion 42*d* of the cylindrical housing 42 is provided with an axial bore 42*e* which has the coaxial cable 1 received therein and which is tapered from an edge of the one end portion 42*d* toward the other end portion of the cylindrical housing 42.

The cylindrical retainer member 41 is provided with an axial through bore 41*a* having the coaxial cable 1 received therein. The cylindrical retainer member 41 has, at its one end, a wedge portion 41*b* which is transformable inwardly in a radial direction of the cylindrical retainer member 41 to such an extent that an inner diameter of the wedge portion 41*b* of the cylindrical retainer member 41 becomes smaller than the diameter of the coaxial cable 1. The wedge portion 41*b* of the cylindrical retainer member 41 is transformed inwardly in the radial direction of the cylindrical retainer member 41 to fix the coaxial cable 1 to the cylindrical housing 42 by way of the cylindrical retainer member 41 when the cylindrical retainer member 41 is inserted between the one end portion 42*d* of the cylindrical housing 42 and the coaxial cable 1.

More specifically, in FIG. 17, the wedge portion 41*b* of the cylindrical retainer member 41 is formed with a plurality of slits 41*c* circumferentially equiangularly spaced relationship to each other. Each of the slits 41*c* opens at one end 41*d* of the wedge portion 41*b* of the cylindrical retainer member 41 and extends along a center axis of the cylindrical retainer member 41. The axial bore 42*e* of the one end portion 42*d* of the cylindrical housing 42 has at least an inner diameter smaller than the largest outer diameter of the wedge portion 4 1*b* of the cylindrical retainer member 41. When the cylindrical retainer member 41 is engaged with the one end portion 42*d* of the cylindrical housing 42, the one end 41*d* of the wedge portion 41*b* of the cylindrical retainer member 41 approaches the one end portion 42*d* of the cylindrical housing 42 and is followed by the other end 41*e* of the cylindrical retainer member 41.

By forcibly fitting the cylindrical housing 42 on the wedge portion 41*b* of the cylindrical retainer member 41, the wedge portion 41*b* of the cylindrical retainer member 41 is transformed inwardly in the radial direction of the wedge portion 41*b* of the cylindrical retainer member 41 to fix the coaxial cable 1 to the wedge portion 41*b* of the cylindrical retainer member 41.

Similarly to the third embodiment shown in FIG. 14, the axial bore of the cylindrical housing 42 may be formed with an internal thread, while the cylindrical retainer member 41 may be formed with an external thread engageable with the internal thread of the axial bore of the cylindrical housing 42. In addition, similarly to the third embodiment shown in FIG. 15, the axial bore of the cylindrical housing 42 may be formed with a circular protrusion, while the wedge portion 41*b* of the cylindrical retainer member 41 may be formed with a circular groove engageable with the circular protrusion of the axial bore of the cylindrical housing 42.

As will be appreciated from the foregoing description, the fourth embodiment of the coaxial connector has the same advantages as the first embodiment of the coaxial connector does.

The many features and advantages of the invention are apparent from the detailed specification and thus it is intended by the appended claims to cover all such features and advantages of the invention which fall within the true spirit and scope thereof. Further, since numerous modifications and changes will readily occur to those skilled in the art, it is not desired to limit the invention to the exact construction and operation illustrated and described, and accordingly, all suitable modifications and equivalents may be resorted to, falling with the scope of the invention.

What is claimed is:

1. A coaxial connector for connecting a coaxial cable to some device including another coaxial cable, comprising:

a hollow ring-shaped member threaded with said coaxial cable and having an inner diameter which is slightly larger than an outer diameter of said coaxial cable, said hollow ring-shaped member having an annular cross section;

a cylindrical housing having a seat surface portion which allows said hollow ring-shaped member to be seated thereon; and pressing means for pressing said hollow ring-shaped member seated on said seat surface portion of said cylindrical housing to said cylindrical housing and transforming said hollow ring-shaped member, thereby fixing said coaxial cable to said cylindrical housing.

2. A coaxial connector as set forth in claim 1, in which said hollow ring-shaped member seated on the seat surface portion of said cylindrical housing has a center axis registered with that of said cylindrical housing and has an internal circular axis which includes a center point of said annular cross section of said hollow ring-shaped member and which is included in a cylindrical plane parallel with said center axis of said hollow ring-shaped member, said hollow ring-shaped member having an outer surface intersecting the cylindrical plane at two circular lines, said hollow ring-shaped member having a circular side portion which circularly extends along and in the vicinity of one of said two circular lines remote from said seat surface portion of said cylindrical housing and which is pressed by said pressing means.

3. A coaxial connector as set forth in claim 1, in which said hollow ring-shaped member has a narrow circular inside portion which is firstly brought into contact with said coaxial cable when said hollow ring-shaped member is transformed by said pressing means, said narrow circular inside portion of said hollow ring-shaped member being moved along a plane intersecting a center axis of said hollow ring-shaped member at a right angle while said hollow ring-shaped member is transformed by said pressing means.

4. A coaxial connector as set forth in claim 3, in which said hollow ring-shaped member has a circular portion which is brought into contact with said seat surface portion of said cylindrical housing when said hollow ring-shaped member is seated on said seat surface portion of said cylindrical housing, said circular portion of said hollow ring-shaped member having a largest outer diameter of said hollow ring-shaped member and having a crescent cross section substantially corresponding to a quarter of said annular cross section of said hollow ring-shaped member.

5. A coaxial connector as set forth in claim 4, in which said pressing means comprises a cylindrical pressing member has a circular flat surface which inclines with respect to the center axis of said hollow ring-shaped member, said circular flat surface of said cylindrical pressing member and the center axis of said hollow ring-shaped member defining an angle smaller than a right angle, and said circular flat surface of said cylindrical pressing member being brought in contact with said hollow ring-shaped member when said hollow ring-shaped member is pressed to said cylindrical housing by said pressing means.

6. A coaxial connector as set forth in claim 5, in which said angle is defined in a range from 50° to 80°.

7. A coaxial connector as set forth in claim 4, in which said cylindrical housing has a recess partially defined by said seat surface portion of said cylindrical housing, said recess of said cylindrical housing being formed with an internal thread and allowing said hollow ring-shaped member to be accommodated therein, said pressing means comprising a cylindrical screw member having a circular flat surface which inclines with respect to the center axis of said hollow ring-shaped member, said circular flat surface of said cylindrical screw member and the center axis of said hollow ring-shaped member defining an angle smaller than a right angle, said cylindrical screw member being formed with an external thread engageable with said internal thread of said recess of said cylindrical housing, and said cylindrical screw member being screwed into said recess of said cylindrical housing to bring said circular flat surface of said cylindrical screw member into contact with said hollow ring-shaped member, thereby pressing said hollow ring-shaped member to said cylindrical housing.

8. A coaxial connector for connecting a coaxial cable to some device including another coaxial cable, comprising:

a ring-shaped member threaded with said coaxial cable and having an inner diameter which is slightly larger than an outer diameter of said coaxial cable, said ring-shaped member having a U-shaped cross section;

a cylindrical housing having a seat surface portion which allows said ring-shaped member to be seated thereon; and pressing means for pressing said ring-shaped member seated on said seat surface portion of said cylindrical housing to said cylindrical housing and transforming said ring-shaped member, thereby fixing said coaxial cable to said cylindrical housing.

9. A coaxial connector as set forth in claim 8, in which said ring-shaped member has a center axis registered with that of said seat surface portion of said cylindrical housing and has an internal circular axis which includes a center point of said U-shaped cross section of said ring-shaped member and which is included in a cylindrical plane parallel with said center axis of said ring-shaped member, and said ring-shaped member having an outer surface intersecting the cylindrical plane at a circular line, said ring-shaped member having a circular side portion which circularly extends along and in the vicinity of said circular line and which is pressed by said pressing means.

10. A coaxial connector as set forth in claim 9, in which said ring-shaped member has a narrow circular inside portion which is fit brought into contact with said coaxial cable when said ring-shaped member is transformed by said pressing means, said narrow circular inside portion of said ring-shaped member being moved along a plane which intersects a center axis of said ring-shaped member at a right angle while said ring-shaped member is transformed by said pressing means.

11. A coaxial connector as set forth in claim 10, in which said ring-shaped member has a circular portion which is brought into contact with said seat surface portion of said cylindrical housing when said ring-shaped member is seated on said seat surface portion of said cylindrical housing, said circular portion of said ring-shaped member having a largest outer diameter of said ring-shaped member.

12. A coaxial connector as set forth in claim 11, in which said cylindrical housing has a recess partially defined by said seat surface portion of said cylindrical housing, said recess of said cylindrical housing including a bottom portion formed with a circular protrusion, said circular portion of said ring-shaped member having a circular opening which is engageable with said circular protrusion of said cylindrical housing, and said circular opening of said ring-shaped member being engaged with said circular protrusion of said cylindrical housing when said ring-shaped member is seated on said seat surface portion of said cylindrical housing.

13. A coaxial connector as set forth in claim 11, in which said pressing means comprises a cylindrical pressing member having a circular flat surface which inclines with respect to the center axis of said ring-shaped member, said circular flat surface of said cylindrical pressing member and the center axis of said ring-shaped member defining an angle smaller than a right angle, and said circular flat surface of said cylindrical pressing member being brought in contact with said ring-shaped member when said ring-shaped member is pressed to said cylindrical housing by said pressing means.

14. A coaxial connector as set forth in claim 13, in which said angle is defined in a range from 50° to 80°.

15. A coaxial connector as set forth in claim 11, in which said cylindrical housing has a recess partially defined by said seat surface portion of said cylindrical housing, said recess of said cylindrical housing being formed with an internal thread and allowing said ring-shaped member to be accommodated therein, said pressing means comprising a cylindrical screw member having a circular flat surface which inclines with respect to the center axis of said ring-shaped member, said circular flat surface of said cylindrical screw member and the center axis of said ring-shaped member defining an angle smaller than a right angle, said cylindrical screw member being formed with an external thread engageable with said internal thread of said recess of said cylindrical housing, and said cylindrical screw member being screwed into said recess of said cylindrical housing to bring said circular flat surface of said cylindrical screw member into contact with said ring-shaped member, thereby pressing said ring-shaped member to said cylindrical housing.

16. A coaxial connector for connecting a coaxial cable to some device including another coaxial cable, comprising:

a cylindrical housing having said coaxial cable partially received therein and having one end portion transformable inwardly in a radial direction of said cylindrical housing to such an extent that an inner diameter of said one end portion of said cylindrical housing becomes smaller than a diameter of said coaxial cable; and a cylindrical retainer member formed with an axial through bore through which said coaxial cable is threaded, said axial through bore being engageable with said one end portion of said cylindrical housing, said one end portion of said cylindrical housing being transformed inwardly in the radial direction of said cylindrical housing to fix said coaxial cable to said cylindrical housing when said cylindrical retainer member is engaged with said one end portion of said cylindrical housing.

17. A coaxial cable as set forth in claim 16, in which said one end portion of said cylindrical housing is formed with a plurality of slits circumferentially equiangularly spaced relationship to each other, each of said slits opening at an edge of said one end portion of said cylindrical housing and extending along a center axis of said cylindrical housing, said axial through bore of said cylindrical retainer member being tapered from one end of said cylindrical retainer member toward the other end of said cylindrical retainer member, said cylindrical retainer member having an inner diameter smaller than a largest outer diameter of said one end portion of said cylindrical housing, and said one end of said cylindrical retainer member approaching said one end portion of said cylindrical housing and being followed by said other end of said cylindrical retainer member when said cylindrical retainer member is engaged with said one end portion of said cylindrical housing.

18. A coaxial connector for connecting a coaxial cable to some device including another coaxial cable, comprising:

a cylindrical housing having one end and the other end portions axially opposite to each other, said one end portion of said cylindrical housing being provided with an axial bore which has said coaxial cable received therein and which is tapered from an edge of said one end portion toward said other end portion of said cylindrical housing; and a cylindrical retainer member provided with an axial through bore having said coaxial cable received therein, said cylindrical retainer member has, at its one end, a wedge portion which is transformable inwardly in a radial direction of said cylindrical retainer member to such an extent that an inner diameter of said wedge portion of said cylindrical retainer member becomes smaller than a diameter of said coaxial cable, said wedge portion of said cylindrical retainer member being transformed inwardly in the radial direction of said cylindrical retainer member to fix said coaxial cable to said cylindrical housing by way of said cylindrical retainer member when said cylindrical retainer member is inserted between said one end portion of said cylindrical housing and said coaxial cable.

19. A coaxial cable as set forth in claim 18, in which said wedge portion of said cylindrical retainer member is formed with a plurality of slits circumferentially equiangularly spaced relationship to each other, each of said slits opening at an edge of said wedge portion of said cylindrical retainer member and extending along a center axis of said cylindrical retainer member, said axial bore of said one end portion of said cylindrical housing having an inner diameter smaller than a largest outer diameter of said wedge portion of the cylindrical retainer member, and said one end of said cylindrical retainer member approaching said one end portion of said cylindrical housing and being followed by said other end of said cylindrical retainer member when said cylindrical retainer member is engaged with said one end portion of said cylindrical housing.

20. A coaxial connector as set forth in claim 1, in which said coaxial cable is covered with a metal thin film.

21. A coaxial connector as set forth in claim 8, in which said coaxial cable is covered with a metal thin film.

22. A coaxial connector as set forth in claim 16, in which said coaxial cable is covered with a metal thin film.

23. A coaxial connector as set forth in claim 18, in which said coaxial cable is covered with a metal thin film.

* * * * *